US005564205A

United States Patent [19]

Smith

[11] Patent Number: 5,564,205

[45] Date of Patent: Oct. 15, 1996

[54] EXCAVATING MACHINE WITH STOWABLE DISCHARGE CONVEYOR

[75] Inventor: Jack D. Smith, The Colony, Tex.

[73] Assignee: Astec Industries, Inc., Chattanooga, Tenn.

[21] Appl. No.: 456,815

[22] Filed: Jun. 1, 1995

[51] Int. Cl.[6] ..... E02F 5/08

[52] U.S. Cl. ..... 37/93; 37/386; 414/373; 414/467

[58] Field of Search ..... 37/91–97, 386–389, 37/462, 463, 209, 244; 414/373, 467; 460/114, 115; 56/16.6; 299/39.2, 64, 43; 198/861.4, 861.6; 404/108

[56] References Cited

U.S. PATENT DOCUMENTS

| | | | |
|---|---|---|---|
| 1,154,545 | 9/1915 | Penedo | 37/463 X |
| 2,123,328 | 7/1938 | Cartlidge | 198/861.4 |
| 3,974,580 | 8/1976 | Satterwhite | 37/95 X |
| 4,063,375 | 12/1977 | Satterwhite | 37/190 |
| 4,162,584 | 7/1979 | Satterwhite | 37/190 |
| 4,180,927 | 1/1980 | Satterwhite | 37/190 |
| 4,281,955 | 8/1981 | McWilliams | 414/398 |
| 4,713,898 | 12/1987 | Bull et al. | 37/104 X |
| 4,736,534 | 4/1988 | Daniels et al. | 37/91 |
| 4,755,001 | 7/1988 | Gilbert | 299/39 |
| 5,070,632 | 12/1991 | Gilbert | 37/90 |
| 5,092,657 | 3/1992 | Bryan, Jr. | 299/1.1 |
| 5,219,380 | 6/1993 | Young et al. | 37/359 |
| 5,228,220 | 7/1993 | Bryan, Jr. | 37/364 |
| 5,245,768 | 9/1993 | Purkeypile | 37/347 |
| 5,295,735 | 3/1994 | Cobbs et al. | 299/86 |

*Primary Examiner*—Terry Lee Melius
*Assistant Examiner*—Victor Batson
*Attorney, Agent, or Firm*—Nilles & Nilles, S.C.

[57] ABSTRACT

An excavating machine includes a discharge conveyor which is movable (1) from an operative position in which an inlet end thereof is located directly under the outlet end of an associated loading conveyor (2) to a transport position in which the discharge conveyor extends substantially in parallel with the loading conveyor and in which the discharge end thereof is located between the inlet and discharge ends of the loading conveyor—thereby maintaining the discharge conveyor within the dimensional confines of the vehicle on which it is mounted. Movement of the discharge conveyor from its operative position to its stowed or transport position is facilitated by a support assembly including a slide and a turntable assembly. The slide includes a base which is mounted on rails or the like so as to move laterally with respect to the chassis, and the turntable assembly supports the discharge conveyor on the base for rotation about a vertical axis. By mounting the turntable assembly on a sliding base in this manner, 270° rotation of the discharge conveyor is possible without interference from the loading conveyor.

18 Claims, 8 Drawing Sheets

EXCAVATING MACHINE WITH STOWABLE DISCHARGE CONVEYOR

BACKGROUND OF THE INVENTION

1. Field of the Invention

The invention relates to excavating machines and, more particularly, relates to self-propelled excavating machines having a vehicle, a digging implement mounted on the vehicle, and a stowable discharge conveyor which is mounted on the vehicle and which is movable from an operative position in which the discharge conveyor discharges excavated materials into a truck to a transport position in which the discharge conveyor is confined within the dimensional confines of the vehicle.

2. Discussion of the Related Art

Excavating machines such as rock saws, chain trenchers, and road miners typically comprise a self-propelled vehicle having a digging implement mounted on the rear end thereof which excavates soil, rock, ore, or other materials as the vehicle travels in a forward direction. Digging implements have traditionally discharged materials on the ground in front of or beside the digging implement on the assumption that the excavated materials would be used as backfill for the trench. However, in recent times, governmental regulations and other considerations have required that the excavated materials be removed from the work site and that "clean" backfill be brought in from other sources. Removing materials excavated by traditional excavating machines requires that the materials be retrieved either manually or by a front-end loader or the like after the trenching operation is complete. The cost of such subsequent retrieval, coupled with the difficulty of retrieving all excavated materials without at least some of the materials falling back into the trench, has led increasingly to a demand for excavating machines which discharge excavated materials directly onto a truck positioned in front of or beside the vehicle.

A particularly attractive arrangement for conveying excavated materials to a truck from a digging implement is a so-called centerline conveyor assembly positioned on or near a longitudinal centerline of the vehicle. The typical centerline conveyor assembly includes a loading conveyor and a discharge conveyor. The loading conveyor receives excavated materials from the digging implement (either directly or indirectly via one or more intervening lateral conveyors) and conveys the excavated materials to a discharge end thereof located in the vicinity of the front end of the vehicle. The discharge conveyor has an inlet end positioned under the discharge end of the loading conveyor and extends forwardly from the front end of the vehicle to discharge excavated materials into a truck from a discharge end thereof. The typical discharge conveyor is swingable on a turntable or shaft so as to be capable of discharging materials onto a truck positioned on either side of the vehicle.

One disadvantage of discharge conveyors is that, in most instances, they extend ten feet or more in front of the excavating vehicle when in their longitudinally-centered position, rendering the overall length of the excavating machine unacceptable for transport. This problem could be alleviated by stowing the discharge conveyor, e.g., by swinging the discharge conveyor to the side of the loading conveyor. However, only limited side-to-side movement is possible (typically in an arc of about 180° extending 90° from each side of the longitudinal centerline of the vehicle) due to potential interference from the loading conveyor. This limited movement may reduce the overall length of the excavating machine, but unacceptably increases its width. Accordingly, transport of excavating machines having discharge conveyors has traditionally required the removal or at least partial disassembly of the discharge conveyors prior to transport.

OBJECTS AND SUMMARY OF THE INVENTION

It is therefore an object of the invention to provide a stowable discharge conveyor for an excavating machine which is movable (1) from an operative position in which it is capable of discharging excavated materials into a truck located either in front of or to either side of the excavating machine, (2) to a transport position in which it is maintained within the dimensional confines of the vehicle on which it is mounted.

Another object of the invention is to provide an excavating machine the discharge conveyor of which has the characteristics described above and which has a vertical axis of rotation which is locatable on the longitudinal centerline of the associated loading conveyor so as to be capable of extending equidistantly to either side of the loading conveyor, thereby facilitating discharge into trucks located on either side of the vehicle.

Still another object of the invention is to provide an excavating machine having a discharge conveyor which has one or more of the characteristics described above and which is relatively simple and inexpensive to install and operate.

In accordance with a first aspect of the invention, these and other objects are achieved by providing an excavating machine comprising a portable chassis having first and second longitudinal ends, a digging implement mounted on the first end of the chassis, a loading conveyor, and a discharge conveyor. The loading conveyor extends longitudinally of the chassis and has an inlet end which receives excavated materials from the digging implement and a discharge end which is located in the vicinity of the second end of the chassis. The discharge conveyor has an inlet end which receives the excavated materials from the loading conveyor and has a discharge end. The discharge conveyor is movable (1) from an operative position in which the inlet end thereof is located directly under the discharge end of the loading conveyor (2) to a transport position (a) in which the discharge conveyor extends substantially in parallel with the loading conveyor and (b) in which the discharge end of the discharge conveyor is located between the inlet and discharge ends of the loading conveyor.

A preferred mechanism for moving the discharge conveyor as described above is a support assembly which supports the discharge conveyor on the chassis. The support assembly include a base which is movable laterally with respect to the chassis, and a turntable assembly which supports the discharge conveyor on the base for rotation about a vertical axis. The base is located (1) in a first position located on a longitudinal centerline of the loading conveyor when the discharge conveyor is in the operative position and (2) in a second position which is offset laterally from the longitudinal centerline when the discharge conveyor is in the transport position. The support assembly also preferably presents rails extending transversely of the chassis such that the base is slidably supported on the rails. A hydraulic cylinder (1) is connected to the base and to the frame support and (2) drives the base to slide along the rails from the first position to the second position.

Preferably, in order to further facilitate transport, the loading conveyor is pivotable about a horizontal axis (1) to raise the inlet end thereof from a lowered operative position to a raised transport position and (2) to lower the discharge end thereof from a raised operative position to a transverse position below a level of the inlet end of the discharge conveyor.

Yet another object of the invention is to provide a simple and effective method of moving a discharge conveyor of an excavating machine from an operative position to a stowed or transport position in which the discharge conveyor is maintained within the dimensional confines of the vehicle on which it is mounted.

Yet another object of the invention is to provide a method of excavating materials using an excavating machine and of stowing a discharge conveyor of the machine within the dimensional confines of the vehicle on which it is mounted for transport.

In accordance with another aspect of the invention, these and other objects are achieved by providing a method comprising providing an excavating machine, operating the machine, and then preparing the excavating machine for transport. The providing step comprises providing a machine having (1) a portable chassis having first and second longitudinal ends, (2) an excavating machine mounted on the first end of the chassis, (3) a loading conveyor extending longitudinally of the chassis, the loading conveyor having an inlet end located in the vicinity of the first end of the chassis and having a discharge end located in the vicinity of the second end of the chassis, and (4) a discharge conveyor having inlet and discharge ends. The operating step comprises placing the excavating machine in an operative position in which the discharge end of the loading conveyor is located above the inlet end of the discharge conveyor and in which the inlet end of the discharge conveyor is located on a longitudinal centerline of the loading conveyor. Then, while the excavating machine is in the operative position, (1) materials are excavated using the digging implement, (2) the excavated materials are fed to the discharge conveyor using the loading conveyor, and (3) the excavated materials are discharged from the excavating machine using the discharge conveyor. The step of preparing the machine for transport comprises moving the discharge conveyor laterally away from the longitudinal centerline of the loading conveyor, and then rotating the discharge conveyor into a position in which the discharge conveyor extends substantially in parallel with the loading conveyor and in which the discharge end thereof is located between the inlet and discharge ends of the loading conveyor.

Preferably, the moving step comprises sliding the discharge conveyor along rails extending transversely of the chassis, and the rotating step comprises driving a table to rotate about a bearing which is supported on a base, the table supporting the inlet end of the discharge conveyor, and the base being slidably mounted on the rails.

In order to facilitate access by a truck during operation of the excavating machine, a further step preferably comprises rotating the discharge conveyor about a vertical axis (1) from a first position in which the discharge conveyor extends laterally over a first side of the chassis and the discharge end thereof is positioned a designated distance from a longitudinal centerline of the loading conveyor, (2) to a second position in which the discharge conveyor extends laterally over a second side of the chassis and the discharge end thereof is positioned the designated distance from the longitudinal centerline of the loading conveyor.

Finally, the step of preparing the excavating machine for transport preferably further comprises pivoting the loading conveyor about a horizonal axis, thereby raising the inlet end of the loading conveyor from a lowered operative position to a raised transport position and lowering the discharge end below a level of the inlet end of the discharge conveyor.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

1. Résumé

Figure 1:
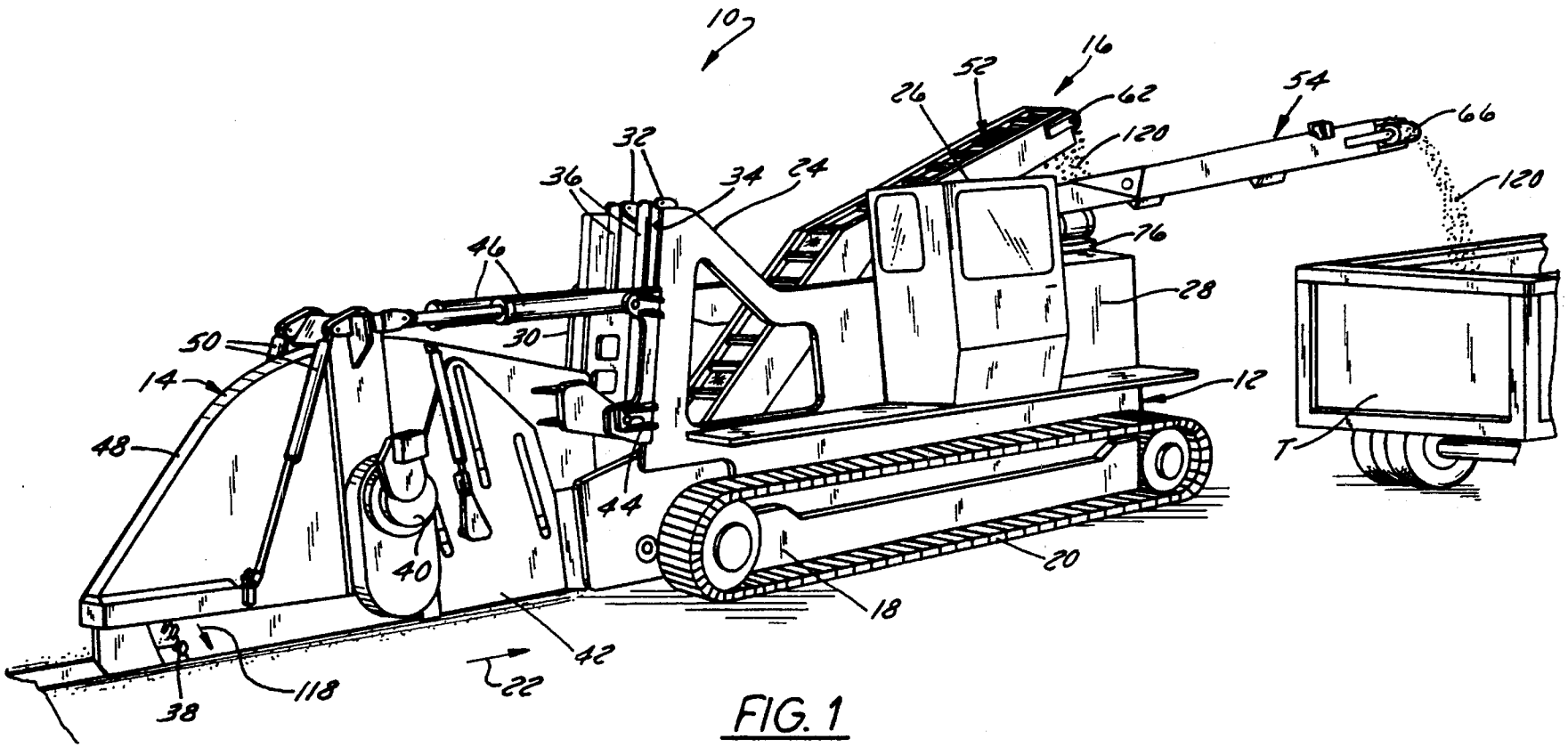
FIG. 1 is a perspective view of an excavating machine employing a conveyor assembly constructed in accordance with a preferred embodiment of the invention and illustrating the excavating machine in an operative position.
Figure 2:
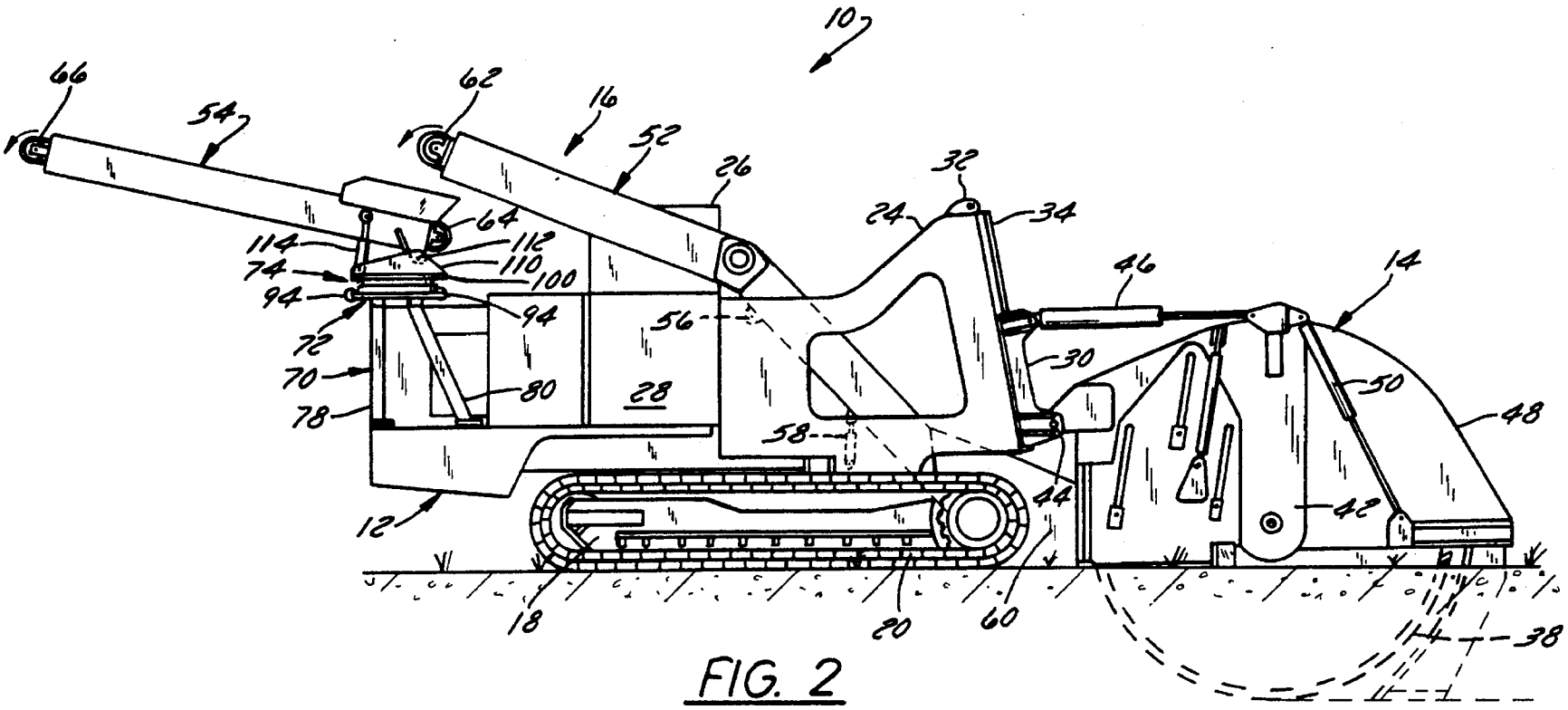
FIG. 2 is a partially cut away side elevation view of the excavating machine of FIG. 1, illustrating the excavating machine in an operative position.

Pursuant to the invention, an excavating machine is provided having a discharge conveyor which is movable (1) from an operative position in which an inlet end thereof is located directly under the outlet end of an associated loading conveyor (2) to a transport position in which the discharge conveyor extends substantially in parallel with the loading conveyor and in which the discharge end thereof is located between the inlet and discharge ends of the loading conveyor—thereby maintaining the discharge conveyor within the dimensional confines of the vehicle on which it is mounted. Movement of the discharge conveyor from its operative position to its stowed or transport position is facilitated by a support assembly including a slide and a turntable assembly. The slide includes a base which is mounted on rails or the like so as to move laterally with respect to the chassis, and the turntable assembly supports the discharge conveyor on the base for rotation about a vertical axis. By mounting the turntable assembly on a sliding base in this manner, 270° rotation of the discharge conveyor is possible without interference from the loading conveyor.

2. System Overview

Referring now to the drawings and initially to FIGS. 1–5 in particular, an excavating machine 10 with which the invention can be employed includes a self-propelled vehicle 12, a digging implement 14 mounted on and extending rearwardly from the longitudinal rear end of the vehicle 12, and a conveyor assembly 16 mounted on the vehicle 12 in front of the digging implement 14. The vehicle 12 includes a chassis 18 mounted on treads 20 for movement along the ground in a direction of travel indicated by the arrow 22 in FIG. 1. Mounted on the chassis 18 are a frame assembly 24, an operator's cab 26, and an engine 28.

The digging implement 14 may comprise any suitable cutting or trenching device, and, in the illustrated embodiment, comprises a rock saw assembly mounted on the frame assembly 24 by a carriage 30. More specifically, a mast 32 is located on the rear end of frame assembly 24, and the carriage 30 is slidably mounted on rails 34 of the mast 32. Carriage 30 can be raised and lowered with respect to the mast 32 by means of hydraulic cylinders 36 to selectively raise and lower the rock saw assembly 14 between the lowered, operative position illustrated in FIGS. 1-3 to the raised, transport position illustrated in FIG. 4. The rock saw assembly 14 includes a rotary toothed cutting wheel 38 driven to rotate by a hydrostatic motor 40 powered by engine 28. A housing 42 rotatably supports the cutting wheel 38 and is pivotally mounted on the carriage 30 at a horizontal pivot axis 44. The housing 42 is pivoted about the axis 44 by a pair of hydraulic cylinders 46 each connected to the mast 32 and to an upper portion of the housing 42. A rear shield 48, pivotable about the housing 42 via operation of hydraulic cylinders 50, preferably, but not necessarily, encases the rear end of the cutting wheel 38.

The conveyor assembly 16 could be positioned to a side of the vehicle 12 and receive materials from the digging implement via one or more lateral conveyors. In the preferred and illustrated embodiment, however, the conveyor assembly 16 is mounted on or near the longitudinal centerline of the vehicle 12 and receives excavated materials directly from the digging implement 14 in order to simplify construction and to reduce the overall width of the excavating machine 10. The conveyor assembly 16 includes a rear loading conveyor 52 and a front discharge conveyor 54. Both the loading conveyor 52 and the discharge conveyor 54 are preferably hydrostatically-driven drag-slat conveyors the motors for which are powered by the engine 28. The loading conveyor 52 is pivotally mounted on the frame assembly 24 via a front pivot mount 56 and rear hydraulic cylinders 58 for reasons which will become apparent below and is inclined upwardly and forwardly from a rear inlet end 60 positioned adjacent the digging implement 14 to a front discharge end 62 positioned in the vicinity of the front end of the vehicle 12.

3. Construction of Discharge Conveyor and Support Assembly

Figure 3:
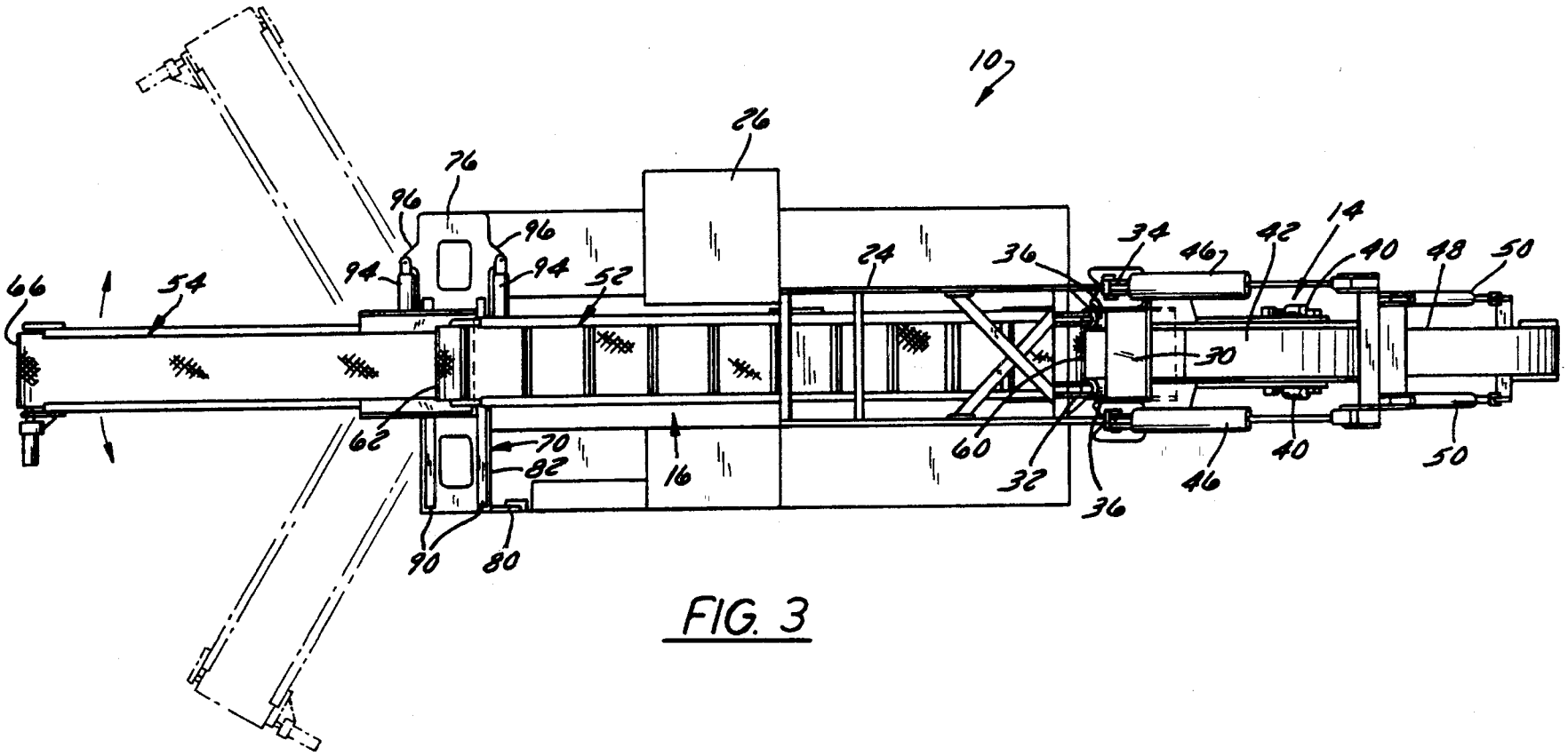
FIG. 3 is a top plan view of the excavating machine of FIGS. 1 and 2, and illustrating in phantom lines side-to-side motion of the discharge conveyor thereof.
Figure 4:
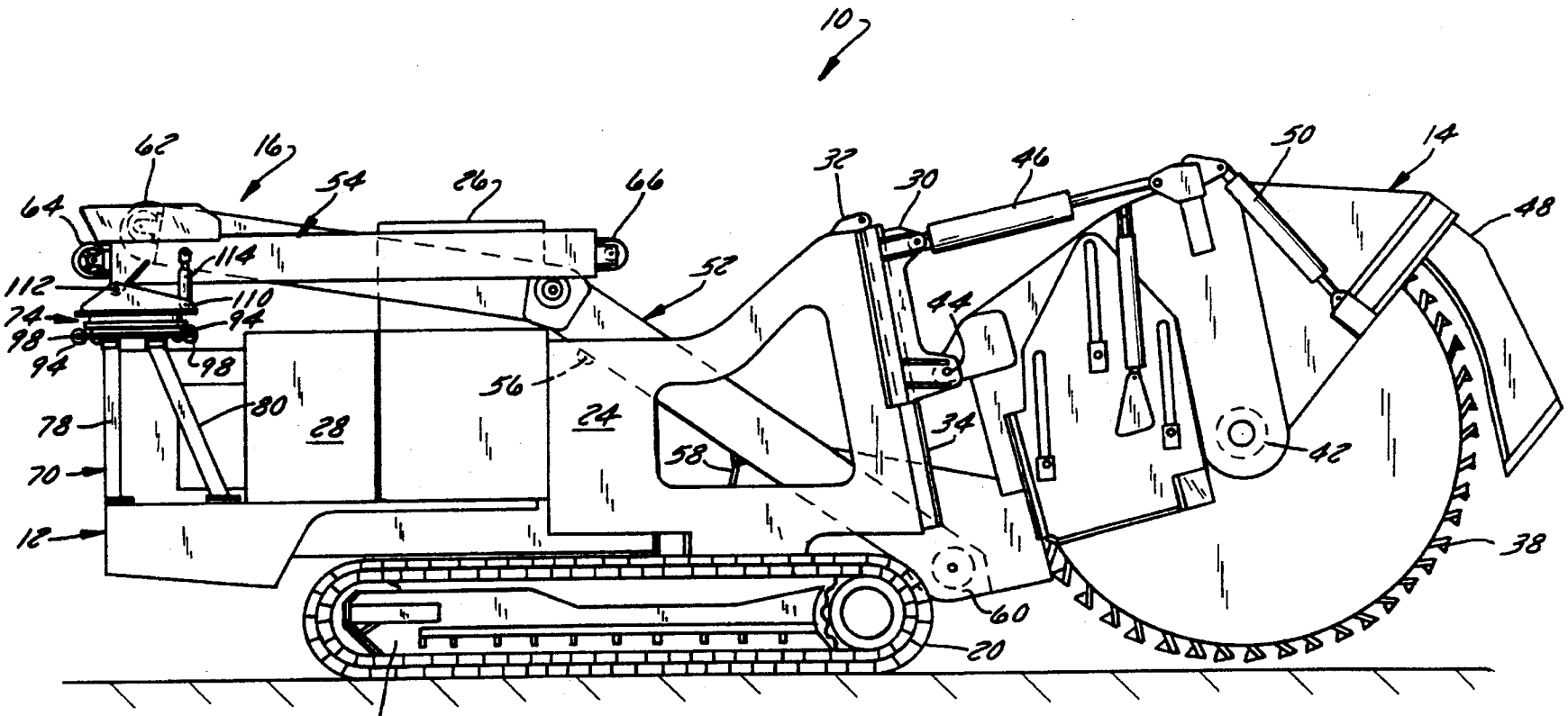
FIG. 4 is a partially cut away side elevation view of the excavating machine of FIGS. 1–3, illustrating the excavating machine in a transport position.
Figure 5:
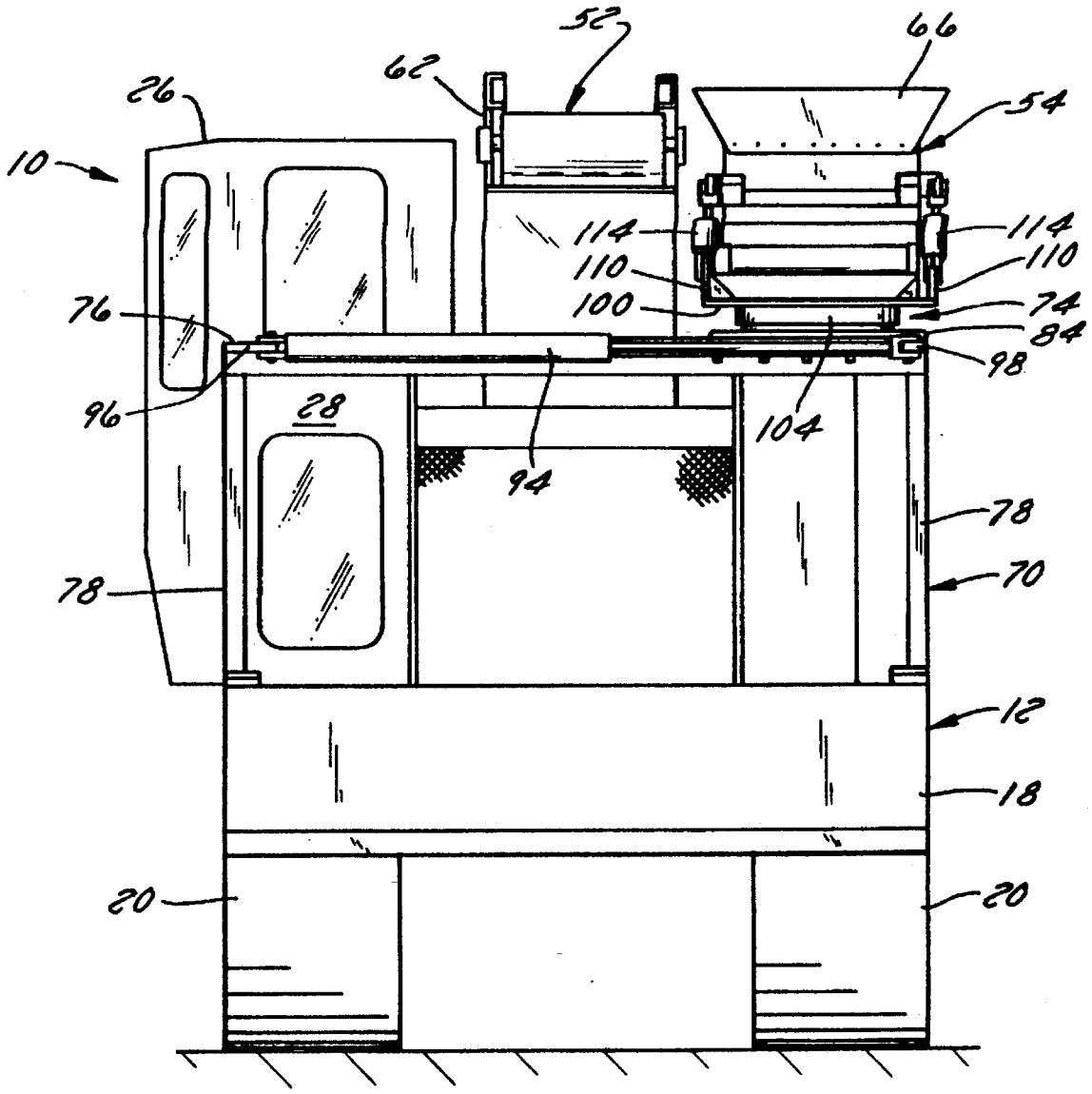
FIG. 5 is a front end elevation view of the excavating machine of FIGS. 1–4, illustrating the conveyor assembly in a stowed or transport position.
Figure 6:
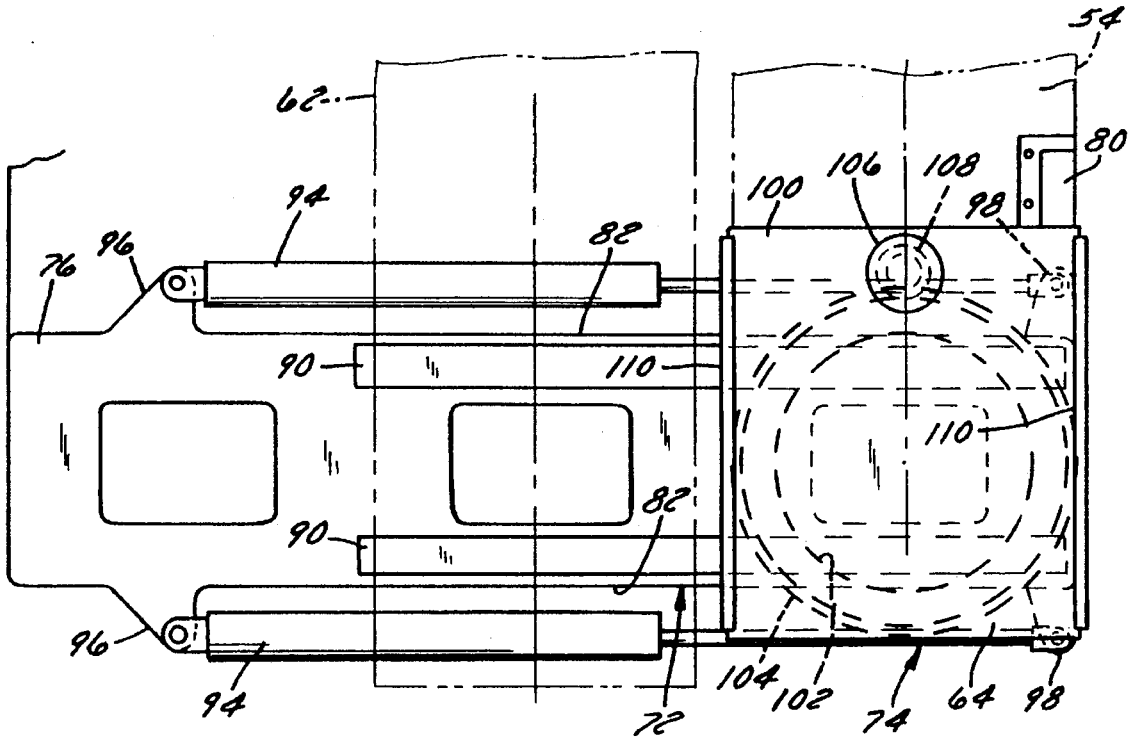
FIGS. 6–8 schematically illustrate the operation of a slide and a turntable assembly supporting the discharge conveyor on the vehicle.
Figure 7:
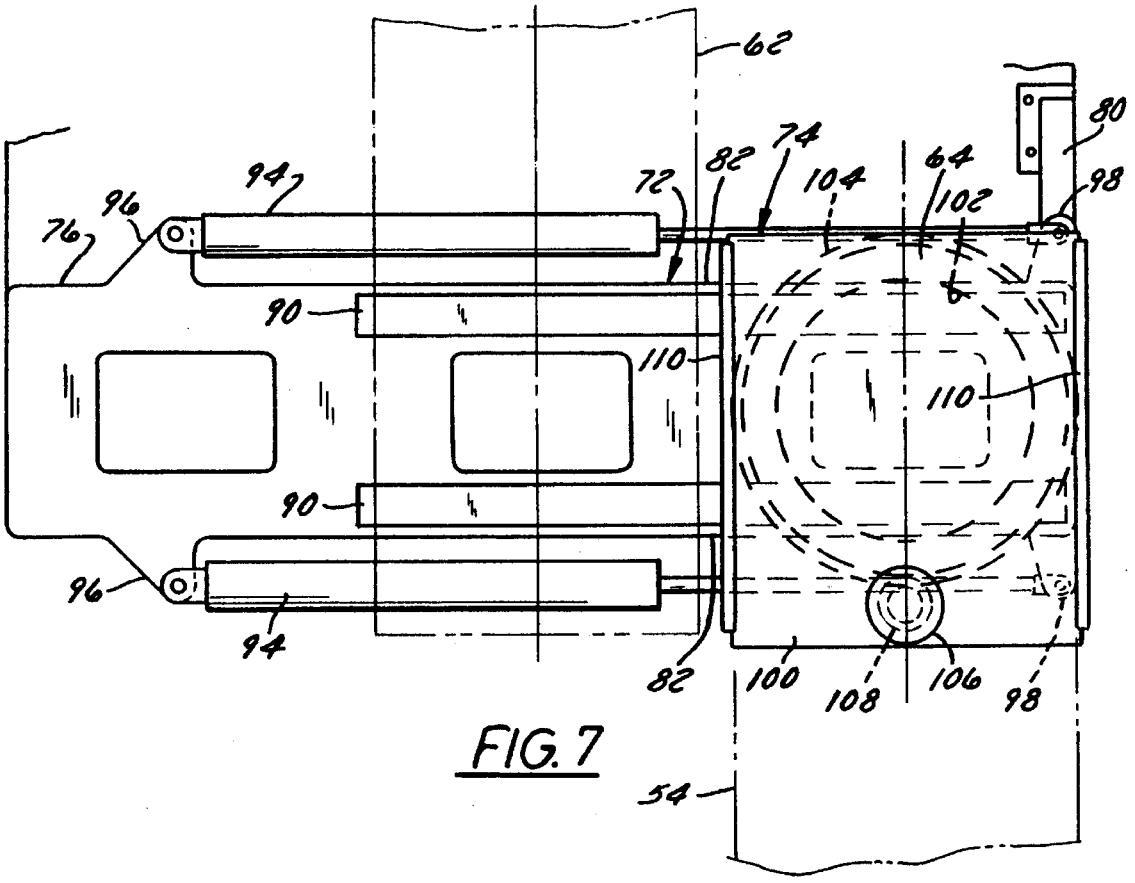
Figure 8:
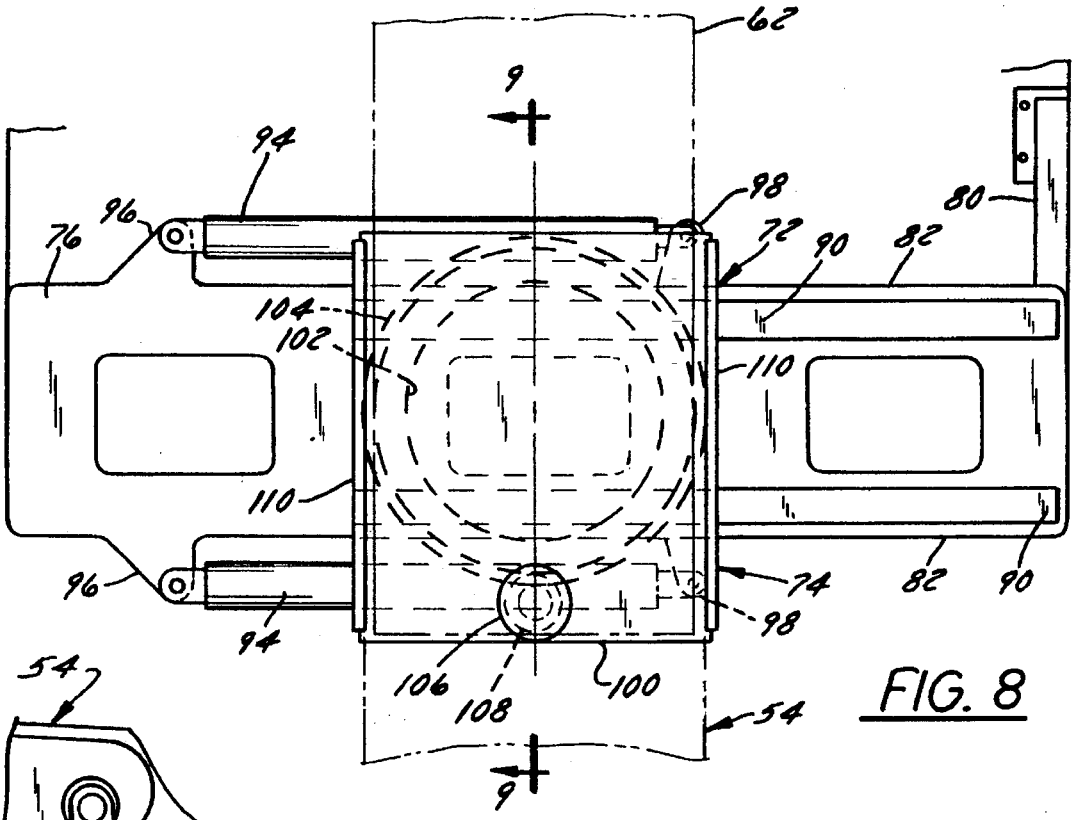
Figure 9:
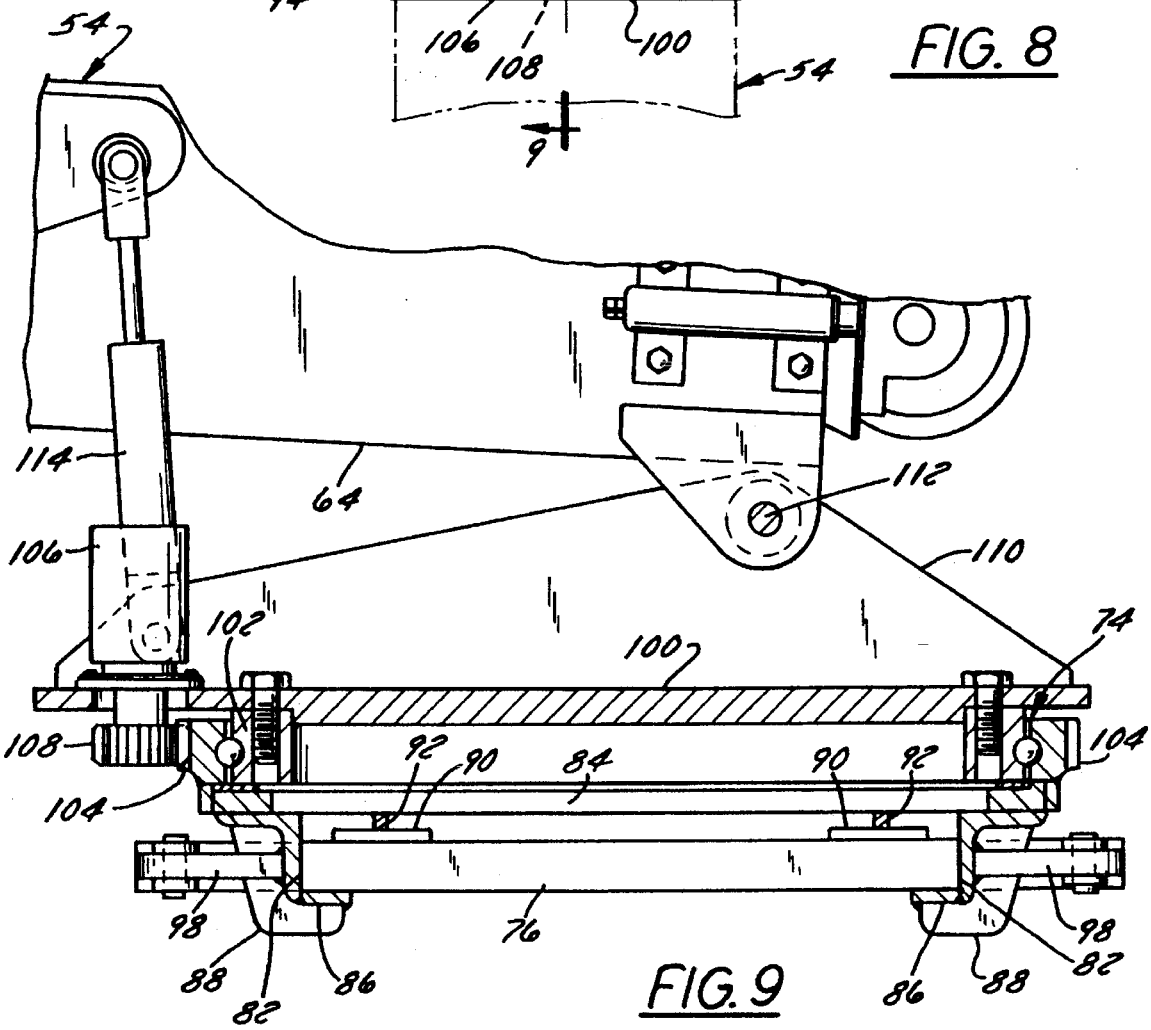
FIG. 9 is a sectional elevation view taken along the lines 9—9 of FIG. 8.
Figure 10:
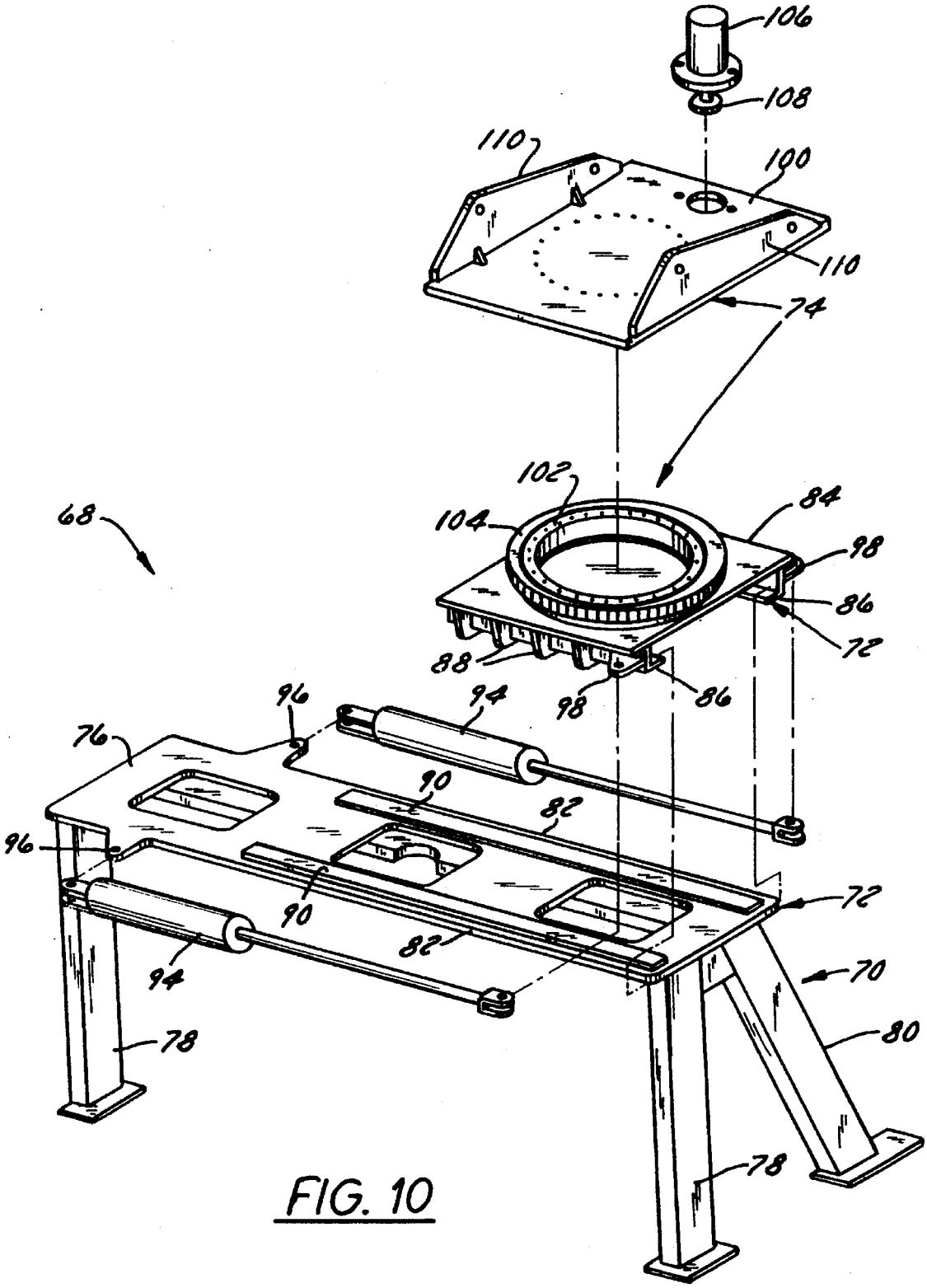
FIG. 10 is an exploded perspective view of the turntable and slide assemblies of FIGS. 6–9.

The discharge conveyor 54 is designed to be movable from an operative position in which an inlet end thereof 64 is positioned directly under the longitudinal centerline of the loading conveyor 52 to a stowed or transport position in which the entire discharge conveyor 54 is maintained substantially within the dimensional confines of the vehicle 12. The discharge conveyor 54 is also designed to swing from side to side as illustrated in FIG. 3 when in its operative position so as to permit the discharge of excavated materials from an outlet end 66 thereof into a truck T (FIG. 1) located either in front of or equidistantly to either side of the vehicle 12. To this end, the inlet end 64 of the discharge conveyor 54 is mounted on the chassis 18 by a support assembly 68 which includes a support frame 70, a slide 72, and a turntable assembly 74.

Referring to FIGS. 5–10, the support frame 70 includes a horizontal plate 76 mounted on the chassis 18 by a pair of laterally-spaced vertical front struts 78 and by a corresponding pair of laterally-spaced inclined rear struts 80. Opposed edge portions of the plate 76 form rails 82 extending transversely of the chassis 18. These rails 82 cooperate with a corresponding base 84 to form the slide 72. Specifically, a pair of L-shaped brackets 86 depend from the lower surface of the base 84. A pair of bars 90 and 92 are mounted on the upper surface of the plate 76 and the lower surface of the base 84, respectively, in a facing relationship with one another. The rails 82 are slidably clamped between the horizontal lower legs of brackets 86 at their lower surfaces and bars 90 and 92 and their upper surfaces. A plurality of L-shaped bars 88 extend transversely with respect to the brackets 86 to reenforce the brackets 86. Sliding movement of the base 84 along the rails 82 is effected via a pair of hydraulic cylinders 94 each of which is pivotally connected to an ear 96 on the plate 76 at its cylinder end and to a corresponding ear 98 on the base 84 at its rod end.

The turntable assembly 74 comprises but one of many devices capable of (1) swinging the discharge conveyor 54 from side to side during operation of the excavating machine 10 and (2) swinging the discharge conveyor 54 into its stowed position for transport. Shafts and hinges could also function adequately for this purpose. The turntable assembly 74, however, is preferred because it provides more stable support for the discharge conveyor 54 and can provide more precise radial displacement of the discharge conveyor 54 than can many other pivot mechanisms. The illustrated and preferred turntable assembly 74 includes a table 100 on which the discharge conveyor 54 is mounted, a bearing 102 rotatably mounting the table 100 on the base 84, and a drive assembly. The drive assembly has a first portion mounted on the base 84 and a second portion mounted on the table 100 such that the first and second portions interact to selectively rotate the table 100 about the bearing 102. In the illustrated and preferred embodiment, the first portion comprises an externally-toothed gear 104 mounted on the base 84 coaxially with the bearing 102, and the second portion comprises (1) a hydrostatically-actuated motor 106 which is bolted or otherwise affixed to the upper surface of the table 100, and (2) a drive pinon 108 which extends downwardly from the table 100 and which meshes with the gear 104. Activation of the motor 106 rotates the pinon 108 to drive the motor 106 and table 100 to rotate about the gear 104, thereby horizontally swinging the discharge conveyor 54.

In addition to being horizontally swingable with respect to the chassis 18, the discharge conveyor 54 is also preferably vertically pivotable with respect to the turntable assembly 74 and chassis 18 to accommodate trucks of different heights. To this end, a pair of support plates 110 extend upwardly from the table 100 and pivotally receive the inlet end 64 of the discharge conveyor 54 at a pivot axis 112. Each of a pair of hydraulic cylinders 114 is pivotally connected to a respective one of the side plates 110 at its cylinder end and to the discharge conveyor 54 at its rod end at a location intermediate the inlet and discharge ends thereof. Extension or retraction of cylinders 114 accordingly pivots the discharge conveyor 54 about its axis 112 to raise and lower the discharge end 66 with respect to the chassis 18.

4. Operation of Excavating Machine

In operation, a narrow trench 116 is cut through rock or another hard or compacted surface by the rocksaw assembly 14 by rotating the cutting wheel 38 in the direction of arrow 118 in FIG. 1 while the vehicle 12 travels forwardly in the direction of arrow 22. Cylinders 58 are retracted at this time to place the inlet end 60 of the loading conveyor 52 on the ground adjacent the cutting wheel 38, and cylinders 94 are retracted to position the turntable assembly 74 and inlet end 64 of the discharge conveyor 54 on the longitudinal centerline of the loading conveyor 52 so that the inlet end 64 of the discharge conveyor 54 is located directly under the discharge end 62 of the loading conveyor 52. Accordingly, excavated materials 120, thrown onto the loading conveyor 52 by rotation of the cutting wheel 38, are conveyed forwardly with respect to the vehicle 12, discharged onto the discharge conveyor 54 from the loading conveyor 52, and discharged into the truck T via operation of the discharge conveyor 5. As illustrated in FIG. 3, the discharge conveyor 54 can be rotated anywhere within an arc of about 180° by suitable operation of the turntable motor 106 at this time without interference from the loading conveyor 52. Due to this fact, and due to the facts that (1) the discharge conveyor 54 is located on the longitudinal centerline of the loading conveyor 52, and (2) the loading conveyor 52 is positioned on the longitudinal centerline of the chassis 18, excavated materials 120 can be discharged at any designated position equidistant from opposed lateral sides of the chassis 18.

Assuming now that the excavating machine 10 is to be transported, the cylinders 36 and 46 are retracted to raise the carriage 30 on the mast 32 and to pivot the rocksaw assembly 14 upwardly with respect to the carriage 30, thereby raising the cutting wheel 38 a sufficient distance above the ground for transport. The discharge conveyor 54 is then placed into a stowed or transport position by positioning it within the dimensional confines of the vehicle 12 in the following manner: First, the cylinders 94 are extended to drive the base 84 along the rails 82 from the position illustrated in FIG. 8 to the position illustrated in FIG. 7, thereby offsetting the turntable assembly 74 and discharge conveyor 54 from the longitudinal centerline of the loading conveyor 52. Then, motor 106 is activated to rotate the table 100 and discharge conveyor 54 about the base 84 from the position illustrated in FIG. 7 to the position illustrated in FIG. 6 in which the discharge conveyor 54 extends at least substantially in parallel with the loading conveyor 52 and in which the discharge end 66 of the discharge conveyor 54 is located between the inlet and discharge ends 60 and 62 of the loading conveyor 52. Rotation to this position without interference from the loading conveyor 52 is possible only because of the offset relationship between the turntable assembly 74 and the longitudinal centerline of the loading conveyor 52. This offset relationship also permits extension of the cylinders 58 to lower the discharge end 62 of the loading conveyor 52 below the level of the inlet end 64 of the discharge conveyor 54 (a position which otherwise would be prevented by the presence of the discharge conveyor 54) thereby raising the inlet end 60 of the loading conveyor 54 to the transport position illustrated in FIG. 5.

Many changes and modifications could be made to the invention without departing from the spirit thereof. For instance, virtually any digging implement could be used in place of the illustrated rocksaw assembly 14. The orientation of the digging implement 14 and the conveyor assembly 16 relative to the longitudinal ends of the vehicle 12 could also be reversed. Moreover, the loading conveyor 52 need not receive excavated materials directly from a digging implement 14 and need not be positioned on the longitudinal centerline of the chassis 18 as shown. Other arrangements than those described and illustrated could also be used to effect transverse and rotational movement of the discharge conveyor 54 relative to the chassis 18. The scope of these and other modifications will become apparent from the appended claims.

I claim:

1. An excavating machine comprising:

(A) a portable chassis having first and second longitudinal ends;

(B) a digging implement mounted on said first longitudinal end of said chassis;

(C) a loading conveyor extending longitudinally of said chassis, said loading conveyor having an inlet end which receives excavated materials from said digging implement and a discharge end which is located in the vicinity of said second longitudinal end of said chassis; and (D) a discharge conveyor having an inlet end which receives said excavated materials from said loading conveyor and having a discharge end, said discharge conveyor being mounted on said chassis so as to be rotatable with respect to said chassis about a vertical axis, said axis being movable laterally with respect to said chassis, wherein, upon movement of said axis laterally with respect to said chassis and rotation of said discharge conveyor about said axis, said discharge conveyor is movable (1) from an operative position in which said inlet end thereof is located directly under said discharge end of said loading conveyor and said discharge end therefore is positioned beyond said second longitudinal end of said chassis (2) to a transport position (a) in which said discharge conveyor extends substantially in parallel with said loading conveyor and (b) in which said discharge end of said discharge conveyor is located between said inlet and discharge ends of said loading conveyor and between said first and second longitudinal ends said chassis.

2. An excavating machine as defined in claim 1, further comprising a support assembly which supports said discharge conveyor on said chassis, said support assembly including (A) a base which is movable laterally with respect to said chassis; and (B) a turntable assembly which supports said discharge conveyor on said base for rotation about said axis, wherein said base is located (1) in a first position located on a longitudinal centerline of said loading conveyor when said discharge conveyor is in said operative position and (2) in a second position which is offset laterally from said longitudinal centerline when said discharge conveyor is in said transport position.

3. An excavating machine comprising:

(A) a portable chassis having first and second longitudinal ends;

(B) a digging implement mounted on said first longitudinal end of said chassis;

(C) a loading conveyor extending longitudinally of said chassis, said loading conveyor having an inlet end which receives excavated materials from said digging implement and a discharge end which is located in the vicinity of said second longitudinal end of said chassis;

(D) a discharge conveyor having an inlet end which receives said excavated materials from said loading conveyor and having a discharge end, said discharge conveyor being movable (1) from an operative position in which said inlet end thereof is located directly under said discharge end of said loading conveyor (2) to a transport position (a) in which said discharge conveyor extends substantially in parallel with said loading conveyor and (b) in which said discharge end of said discharge conveyor is located between said inlet and discharge ends of said loading conveyor; and (E) a support assembly which supports said discharge conveyor on said chassis, said support assembly including (1) a base which is movable laterally with respect to said chassis, and (2) a turntable assembly which supports said discharge conveyor on said base for rotation about a vertical axis, wherein said base is located (1) in a first position located on a longitudinal centerline of said loading conveyor when said discharge conveyor is in said operative position and (2) in a second position which is offset laterally from said longitudinal centerline when said discharge conveyor is in said transport position, wherein said support assembly further comprises a support frame which presents rails extending transversely of said chassis, and wherein said base is slidably supported on said rails, and further comprising a hydraulic cylinder (1) which is connected to said base and to said support frame and (2) which drives said base to slide along said rails from a first position to a second position.

4. An excavating machine as defined in claim 3, wherein said support assembly includes a plate having edge portions forming said rails, and wherein said base has L-shaped members depending therefrom which engage said edge portions.

5. An excavating machine as defined in claim 2, wherein said turntable assembly comprises a table on which said discharge conveyor is mounted;

a bearing rotatably mounting said table on said base; and a drive assembly having a first portion mounted on said base and a second portion mounted on said table, said first and second portions of said drive assembly interacting to selectively rotate said table about said bearing.

6. An excavating machine as defined in claim 5, wherein said drive assembly comprises (1) a gear which is mounted on said base coaxially with said bearing, (2) a motor which is mounted on said table, and (3) a pinion which is driven by said motor and which meshes with said gear.

7. An excavating machine as defined in claim 2, wherein said discharge conveyor is pivotable vertically with respect to said turntable assembly, and further comprising a hydraulic cylinder which is connected to said discharge conveyor and to said turntable assembly and which is pivots said discharge conveyor with respect to said turntable assembly.

8. An excavating machine as defined in claim 2, wherein said loading conveyor is pivotable about a horizontal axis (1) to raise said inlet end thereof from a lowered operative position to a raised transport position and (2) to lower said discharge end thereof from a raised operative position to a transverse position below a level of said inlet end of said discharge conveyor.

9. An excavating machine as defined in claim 1, wherein said digging implement comprises a rock saw assembly.

10. An excavating machine comprising:

(A) a portable chassis having first and second longitudinal ends;

(B) a digging implement mounted on said first longitudinal end of said chassis;

(C) a loading conveyor extending longitudinally of said chassis, said loading conveyor having an inlet end which receives excavated materials from said digging implement and a discharge end which is located in the vicinity of said second longitudinal end of said chassis;

(D) a discharge conveyor having an inlet end which receives said excavated materials from said loading conveyor and having a discharge end; and (E) a support assembly which supports said discharge conveyor on said chassis, said support assembly including (1) a support frame, (2) a base which is mounted on said support frame and which is movable laterally with respect to said chassis from a location on a longitudinal centerline of said loading conveyor to a location which is offset laterally from said longitudinal centerline, and (3) a turntable assembly which supports said discharge conveyor on said base for rotation about a vertical axis.

11. An excavating machine as defined in claim 10, wherein said support assembly further comprises rails which are supported on said support frame and upon which said base is slidably mounted, and further comprising a hydraulic cylinder (1) which is connected to said base and to said support frame and (2) which drives said base to slide along said rails from a first position to a second position.

12. An excavating machine as defined in claim 11, wherein said rails comprise edge portions of said frame and said base has L-shaped bars depending therefrom which engage said edge portions.

13. An excavating machine as defined in claim 10, wherein said turntable assembly comprises a table on which said discharge conveyor is mounted;

a bearing rotatably mounting said table on said base; and a drive assembly having a first portion mounted on said base and a second portion mounted on said table, said first and second portions of said drive assembly interacting to selectively rotate said table about said bearing.

14. A method comprising:

(A) providing an excavating machine having (1) a portable chassis having first and second longitudinal ends, (2) an excavating machine mounted on said first longitudinal end of said chassis, (3) a loading conveyor extending longitudinally of said chassis, said loading conveyor having an inlet end located in the vicinity of said first end of said chassis and having a discharge end located in the vicinity of said second longitudinal end of said chassis, and (4) a discharge conveyor having inlet and discharge ends;

(B) placing said excavating machine in an operative position in which said discharge end of said loading conveyor is located above said inlet end of said discharge conveyor and in which said inlet end of said discharge conveyor is located on a longitudinal centerline of said loading conveyor;

(C) while said excavating machine is in said operative position, (1) excavating materials using said digging implement, (2) feeding excavated materials to said discharge conveyor using said loading conveyor, and (3) discharging excavated materials from said excavating machine using said discharge conveyor; and then (D) placing said excavating machine in a transport position by (1) moving said discharge conveyor laterally away from said longitudinal centerline of said loading conveyor, and then (2) rotating said discharge conveyor into a position in which said discharge conveyor extends substantially in parallel with said loading conveyor and in which said discharge end thereof is located between said inlet and discharge ends of said loading conveyor.

15. A method as defined in claim 14, wherein said moving step comprises sliding said discharge conveyor along rails extending transversely of said chassis.

16. A method as defined in claim 15, wherein said rotating step comprises driving a table to rotate about a bearing which is supported on a base, said table supporting said inlet end of said discharge conveyor, and said base being slidably mounted on said rails.

17. A method as defined in claim 14, further comprising, during said step (C), rotating said discharge conveyor about a vertical axis (1) from a first position in which said discharge conveyor extends laterally over a first side of said chassis and said discharge end thereof is positioned a designated distance from a longitudinal centerline of said loading conveyor, (2) to a second position in which said discharge conveyor extends laterally over a second side of said chassis and said discharge end thereof is positioned said designated distance from said longitudinal centerline of said loading conveyor.

18. A method as defined in claim 14, further comprising pivoting said loading conveyor about a horizonal axis during step (D), thereby raising said inlet end of said loading conveyor from a lowered operative position to a raised transport position and lowering said discharge end below a level of said inlet end of said discharge conveyor.

* * * * *